US005346318A

United States Patent [19]

Endo

[11] Patent Number: 5,346,318

[45] Date of Patent: Sep. 13, 1994

[54] THERMAL RECORDING HEAD DRIVING DEVICE

[75] Inventor: Takafumi Endo, Hyogo, Japan

[73] Assignee: Mitsubishi Denki Kabushiki Kaisha, Tokyo, Japan

[21] Appl. No.: 952,254

[22] Filed: Sep. 28, 1992

[30] Foreign Application Priority Data

Oct. 3, 1991 [JP] Japan ..... 3-281906
Oct. 21, 1991 [JP] Japan ..... 3-299621

[51] Int. Cl.[5] ..... B41J 2/36

[52] U.S. Cl. ..... 400/120.15; 346/76 PH; 400/120.14

[58] Field of Search ..... 400/120; 346/76 PH

[56] References Cited

U.S. PATENT DOCUMENTS 4,330,786 5/1982 Hatabe et al. ..... 346/76 PH
4,518,971 5/1985 Endo ..... 400/120
4,591,877 5/1986 Shiratsuki ..... 400/120
4,695,847 9/1987 Ishii et al. ..... 400/120
4,700,199 10/1987 Horlander ..... 400/120
4,704,617 11/1987 Sato et al. ..... 400/120
4,937,590 6/1990 Robillard ..... 400/120
5,115,252 5/1992 Sasaki ..... 400/120
5,132,703 7/1992 Nakayama ..... 400/120

FOREIGN PATENT DOCUMENTS 34171 2/1988 Japan ..... 400/157.2
64-67365 3/1989 Japan ..... 400/120

*Primary Examiner*—David A. Wiecking
*Assistant Examiner*—Steven S. Kelley
*Attorney, Agent, or Firm*—Rothwell, Figg, Ernst & Kurz

[57] ABSTRACT

Disclosed herein is a recording head driving device for driving a number of recording heads such as thermal heads or the like for printing characters on recording mediums. A control signal; for controlling the time required to energize each of the recording heads; is input to recording-head driving gate circuits from AND gates and/or OR gates in accordance with the present and/or past recorded information output from adjacent latch circuits. A plurality of collating circuits are provided each of which allows each of the latch circuits to retain or hold recorded information on at least past three lines as the previous recorded information and feeds back the past latch outputs of the latch circuit to any one of the outputs of the latch circuit.

4 Claims, 14 Drawing Sheets

CLOCK

DATA

LATCH SIGNAL

GA

GB

GC
Q3 Q2 Q1

L L H

H L H

L H H

H H H

L→L→H
PRESENT LINE INFORMATION
PREVIOUS LINE INFORMATION
PRIOR TO THE PREVIOUS LINE INFORMATION
1.0

H→L→H
1.5
TEMPERATURE

L→H→H
2.0

H→H→H
3.0
(PRIOR TO THE PREVIOUS LINE)
(PREVIOUS LINE)
(PRESENT LINE)

FIG. 5 ( PRIOR ART )

| | CONTENT OF LATCH DATA | | | POINT NUMBER OF TEMPERATURE RISE |
|---|---|---|---|---|
| | Q3 | Q2 | Q1 | |
| LEVEL 1 | L | L | H | 1.0 |
| LEVEL 2 | H | L | H | 1.5 |
| | L | H | H | 2.0 |
| LEVEL 3 | H | H | H | 3.0 |

FIG. 14

| | CONTENT OF LATCH DATA | | | | | POINT NUMBER OF TEMPERATURE RISE |
|---|---|---|---|---|---|---|
| | Q5 | Q4 | Q3 | Q2 | Q1 | |
| LEVEL 1 | L | L | L | L | H | 1 |
| LEVEL 2 | H | L | L | L | H | 1 |
| | L | H | L | L | H | 1 |
| | L | L | H | L | H | 1.5 |
| | L | L | L | H | H | 2.0 |
| LEVEL 3 | H | H | L | L | H | 2.0 |
| | H | L | H | L | H | 2.0 |
| | H | L | L | H | H | 2.0 |
| | L | H | H | L | H | 2.5 |
| | L | H | L | H | H | 2.5 |
| | L | L | H | H | H | 3.0 |
| LEVEL 4 | H | H | H | L | H | 3.5 |
| | H | H | L | H | H | 3.5 |
| | H | L | H | H | H | 3.5 |
| | L | H | H | H | H | 4.0 |
| LEVEL 5 | H | H | H | H | H | 5.0 |

CLOCK

DATA

LATCH SIGNAL

CONTROL SIGNAL

GA

GB

GC

Q3 Q2 Q1
L L H

H L H

L H H

H H H

CLOCK

DATA

LATCH SIGNAL

CONTROL SIGNAL 1

CONTROL SIGNAL 2

GA

GB

GC
Q3 Q2 Q1

L L H

H L H

L H H

H H H

THERMAL RECORDING HEAD DRIVING DEVICE

BACKGROUND OF THE INVENTION

1. Field of the Invention

The present invention relates to a recording head driving device which serves as a printing unit for printing characters or the like on a recording medium, and more specifically to a recording head driving device for driving a recording head such as a thermal head or the like used for printing of a facsimile system, a printer, etc.

2. Description of the Prior Art

FIG. 1 is a circuit diagram showing a conventional one-dot type thermal head driving circuit which has been illustrated in a catalogue (as entitled "*Thermal Head*, H-C9683-E" described in P25 and issued on Feb., 1991) produced by Mitsubishi Electric Corp. Thermal heads are arranged in such a manner that the thermal head driving circuit is provided with a predetermined number of dots. In the same drawing, reference numeral 1 indicates a shift register for shifting input data on the present line in accordance with a clock. The shift register 1 has steps corresponding to the number of dots relative to the thermal heads.

Designated at numeral 21 is a latch circuit for taking in data which appears at a tap of the shift register 1 so as to retain or hold it therein. Reference numeral 31 indicates a gate signal generating unit for generating three gate signals GA, GB, GC. Designated at numerals 4*a*, 4*b* are reverse logical product (hereafter called "NAND") gates serving as gate circuits supplied with latch outputs Q2, Q3 from the latch circuit 21 and gate signals GB, GC from the gate signal generating unit 31.

Reference numeral 51 indicates a logical product (hereafter called "AND") gate serving as a gate circuit supplied with the outputs of the NAND gates 4*a*, 4*b*, the Q1 output of the latch circuit 21 and the gate signal GA of the gate signal generating unit 31 so as to output a pulse signal indicative of a conductible or energizable state therefrom. Designated at numeral 6 is a darlington transistor serving as a drive circuit for driving or energizing a thermal or heating resistor 7 of a thermal head in response to the pulse signal output from the AND gate 51.

The operation of the thermal head driving circuit will now be described below. FIG. 2 is a timing chart for describing the relationship in time among respective signals.

The shift register 1 first takes in data shown in FIG. 2(B) as an image signal in response to a clock signal shown in FIG. 2(A) and shifts it to a desired location. The latch circuit 21 successively takes in data from the tap of the shift register 1 corresponding to a dot thereof in response to a latch signal shown in FIG. 2(C).

At this time, the latch circuit 21 brings data from the shift register 1 in response to the input latch signal and shifts the latched data one stage. As a result, data on the previous line relative to the dot appears at the Q2 terminal of the latch circuit 21, whereas data on the line prior to the previous line relative to the dot appears at the Q3 terminal.

On the other hand, the gate signal generating unit 31 generates the gate signals GA, GB, GC represented in the form of given patterns as illustrated in FIGS. 2(D), 2(E) and 2(F). The pulse signal to be sent to the heating resistor 7 is determined by the gate signals GA, GB, GC, the outputs Q1, Q2, Q3 of the latch circuit 21, the NAND gates 4*a*, 4*b* and the AND gate 51.

The darlington transistor 6 drives the heating resistor 7 in response to the signal delivered from the AND gate 51 so as to cause the heating resistor 7 to generate heat in proportion to the amount of current which flows into the heating resistor 7 driven by the darlington transistor 6, thereby subjecting a thermal recording paper or the like located on the heating resistor 7 to colour development.

A description will now be made of history control of the amount of current supplied to the heating resistor 7. When the time required for the darlington transistor 6 to cause the heating resistor 7 to conduct current, i.e., energize the heating resistor 7 as shown in FIG. 3(A) is 1 ms, the temperature of the heating resistor 7 reaches 300° C. When, on the other hand, the energization of the heating resistor 7 is repeated in a period corresponding to 2 ms as shown in FIG. 3(B), the heating resistor 7 increases up to a temperature of 500° C.

Thus, even if the same amount of current is provided, the temperature of the heating resistor 7 at the time of completion of the energization thereof is also high when the temperature of the heating resistor 7 at the start of the energization thereof is high. That is, a color-developed density becomes high upon energization of the heating resistor 7 in a quick repeating cycle unless the energy supplied to the heating resistor 7 is controlled.

It is therefore necessary to control the amount of energy depending on the temperature of the heating resistor at the start of its energization. More specifically, the control for the energization of the heating resistor is performed based on a decision made as to whether or not desired data has been recorded at the line prior to the previous line.

This history control is carried out in the following manner. That is, it is necessary to recognize the degree of an increase in temperature with respect to each of patterns (recorded conditions of dots at the present line, the previous line and the line prior to the previous line) in order to determine in what manner the energy should be supplied to a dot at the present line judging from the recorded conditions of the dots at the previous line and the line prior to the previous line, i.e., the energization with respect to its dot should be done.

FIG. 4 is a simplified graph showing the result of simulated increases in temperature with respect to the respective patterns upon non-performance of the history control. In the same drawing, "H" represents that the recording (energization) of dots has been made, whereas "L" represents that the recording (energization) of the dots has not been done. For example, FIG. 4(B) shows that the recording of the dot has been made at the line prior to the previous line and the recording of the dot has not been made at the previous line.

In addition, values (each of which represents the degree of an increase in temperature, but is now called a point number) obtained by normalizing respective temperatures at the time that the energization has been completed at the present line, are shown in FIG. 4. It is understood that the history control should be done in such a manner as to provide large energy because the point number is low as regards "1.0" [see FIG. 4(A)]. Also, a small amount of energy should be provided when the point number is as high as "3.0" as is shown in FIG. 4(D).

FIG. 5 is a view showing the relationship between the point numbers shown in FIG. 4 and the data Q1, Q2, Q3 latched in the latch circuit 21.

As has already been described above, the latch data Q1, Q2, Q3 respectively represent criterion made as to whether or not the dots are recorded at the line prior to the previous line, the previous line and the present line. Now, the number of levels is defined depending on the number of "H". The more the number of "H" produced in a pattern increases, the more the number of levels becomes high. The most suitable energized states corresponding to four kinds of patterns shown in FIG. 5 are represented by FIGS. 2(G) to 2(J).

In order to establish a suitable current amount corresponding to the point numbers, the gate signal generating unit 31 generates the gate signals GA, GB and GC shown in FIGS. 2(D), 2(E) and 2(F). As a result, the outputs of the AND gate 51 corresponding to the output patterns of the latch circuit 21 are represented by FIGS. 2(G) to 2(J), and hence the amount of current associated with the point numbers is set.

That is, the pattern (L, L, H) representative of the low point number is controlled in such a manner that the amount of current increases. The patterns indicative of the large point numbers are controlled such that the amount of current is reduced.

Incidentally, the pulse widths of the gate signals GB, GC are identical to each other. In the case of two patterns in the same level, i.e., in the level 2, the energizing time at one of the two patterns and that at the other thereof are identical in total to each other.

Incidentally, techniques related to the conventional thermal head driving circuit have been disclosed as references in Japanese Patent Application Laid-Open Nos. 63-203346, 64-32973 and 64-67365, for example.

The conventional thermal head driving circuit has been constructed as described above. It is therefore necessary to increase the number of the outputs of the latch circuit 21 when the history control is strictly performed. Thus, the number of patterns to be controlled increases, thereby causing a difficulty in suitably controlling the patterns. Further, when the respective heating resistors provided adjacent to one another are independently controlled, no attention has been paid to the influence of storage of heat generated between the adjacent respective heating resistors. Accordingly, the control of heat history cannot be performed with high accuracy.

SUMMARY OF THE INVENTION

With the foregoing problems in view, it is therefore an object of the present invention to provide a recording head driving device which can supply the most suitable printing energy to each of recording heads by obtaining information recorded, as information indicative of an information recording state between the adjacent recording heads.

Another object of the present invention is to provide a recording head driving device capable of realizing the control of printing density with higher accuracy based on information recorded by recording heads adjacent to one another.

A further object of the present invention is to provide a recording head driving device capable of more reliably effecting the control of the printing density with high accuracy based on the past information recorded by recording heads which are adjacent to one another.

A final objective of the present invention is to provide a recording head driving device capable of suitably realizing history control with less gate signals, even if the number of patterns to be controlled increases as a result of an increase in the number of outputs of a latch circuit.

According to the first aspect of the present invention, there is a recording head driving device comprising a number of latch circuits, each used to retain information on the present line; which is recorded with respect to dots to be energized, and respective information on the previous lines; which is recorded with respect to dots serving as objects to be energized. There is also a number of gate circuits for outputting pulse signals; each pulse signal indicative of an energizable state from each recording head, a gate signal generating unit for outputting gate signals used to generate the pulse signal; each gate signal indicative of the energizable state of each recording head in accordance with each of output patterns of the latch circuits to the gate circuits, and a number of AND gates for inputting a control signal which is used to control the time required to energize each recording head to each of the gate circuits in response to the recorded information output from the original or initial latch circuit and other adjacent latch circuits provided for each dot.

Each of the AND gates according to the first method is activated to input the control signal for controlling the time required to energize each recording head to each of the gate circuits used to drive the recording heads in response to the recorded information output from the initial latch circuit and other adjacent latch circuits, thereby supplying predetermined energy to each corresponding recording head during that energization time. It is thus possible to realize the control of a well-balanced printing density in accordance with the state between the recording heads adjacent to one another.

According to a second aspect of the present invention, there is a recording head driving device comprising a number of latch circuits, each used to retain information on the present line, which is recorded with respect to dots which need to be energized and respective information on previous lines, which is recorded with respect to dots to be energized; a number of gate circuits for outputting pulse signals, each indicative of an energizable state from each recording head; a gate signal generating unit for outputting gate signals, used to generate the pulse signals each indicative of the energizable state of each recording head in accordance with each of output patterns of the latch circuits, to the gate circuits; a number of AND gates each activated so as to input a control signal used to control the time required to energize each recording head to each of the gate circuits in response to the recorded information output from the initial latch circuit, and other adjacent latch circuits of the latch circuits provided for every dot. There is also a plurality of OR gates each activated so as to input a control signal, which is used to control the time difference from the above energization time; this difference is required to energize each recording head, to each of the gate circuits in response to the recorded information output from other adjacent latch circuits excluding the initial latch circuit of the latch circuits provided for every dot.

Each of the OR gates according to the second aspect is activated to input the control signal used to control the time required to energize each recording head to each of the gate circuits. Each control signal is used to drive the recording heads in response to the recorded information output from other adjacent latch circuits excluding the initial latch circuit, thereby supplying predetermined energy to each corresponding recording head during that energization time. It is thus possible to realize the control of a well-balanced printing density with higher accuracy, according to the state between the recording heads adjacent to one another.

According to a third aspect of the present invention, there is a recording head driving device comprising a number of latch circuits each used to retain information on the present line, which is recorded with respect to dots which have to be energized, and respective information on previous lines, which is recorded with respect to dots as to be energized. There is also a number of gate circuits for outputting pulse signals each indicative of an energizable state from each recording head; a gate signal generating unit for outputting gate signals used to generate the pulse signals each indicative of the energizable state of each recording head in accordance with each of output patterns of the latch circuits, to the gate circuits. A number of first AND gates each activated so as to input a control signal used to control the time required to energize each recording head to each of the gate circuits in response to the recorded information output from the initial latch circuit and other adjacent latch circuits of the latch circuits provided for every dot. There is also a number of second AND gates each activated so as to input a control signal to control the time difference from the above energization time. This time difference is required to energize each recording head, to each of the gate circuits in response to the recorded information output from other adjacent latch circuits excluding the initial latch circuit of the latch circuits provided for every dot.

Each of the second AND gates is activated to input the control signal, to control the time required to energize each recording head in response to the past recorded information output from other adjacent latch circuits; excluding the initial latch circuit, thereby supplying the energy determined by that energization time to each corresponding recording head. As a consequence, the control of a well-balanced printing density can be achieved with higher accuracy in accordance with the state between the adjacent recording heads.

According to a fourth aspect of the present invention, there is a recording head driving device comprising a number of collating circuits each activated to allow the latch circuit to retain the recorded information on at least three previous lines; as the recorded information on the previous lines, and feed back the past latch outputs of the latch circuit to any one of the outputs of the latch circuit.

Each of the collating circuits according to the fourth aspect is activated to feed back the past latch outputs of the latch circuit which has latched therein information on the present line and information on the past three lines; both of which have been recorded with respect to each dot serving as an object to be driven for each recording heads, to any one of the outputs of the latch circuit, thereby making it possible to control the amount of heat generated by each heating resistor which has referred to the past recorded information. It is thus possible to realize a recording head driving device capable of suitably carrying out history control with a smaller number of gate signals.

The above and other objects, features and advantages of the present invention will become apparent from the following description and the appended claims, taken in conjunction with the accompanying drawings. The accompanying drawings are used only for illustration and do not limit the scope of the invention.

BRIEF DESCRIPTION OF THE DRAWINGS

FIG. 5 is a view for describing the relationship between latch data representative of the four kinds of latch patterns output from the latch circuits in the conventional thermal head driving device and point numbers relative to increases in temperatures;

FIG. 14 is a view for describing the relationship between latch data indicative of five kinds of patterns output from latch circuits in a recording head driving device according to a still further object of the present invention and points numbers relative to increases in temperatures.

DETAILED DESCRIPTION OF THE PREFERRED EMBODIMENTS

Preferred embodiments of the present invention will hereinafter be described in detail with reference to the accompanying drawings.

Embodiment 1

Figure 6:
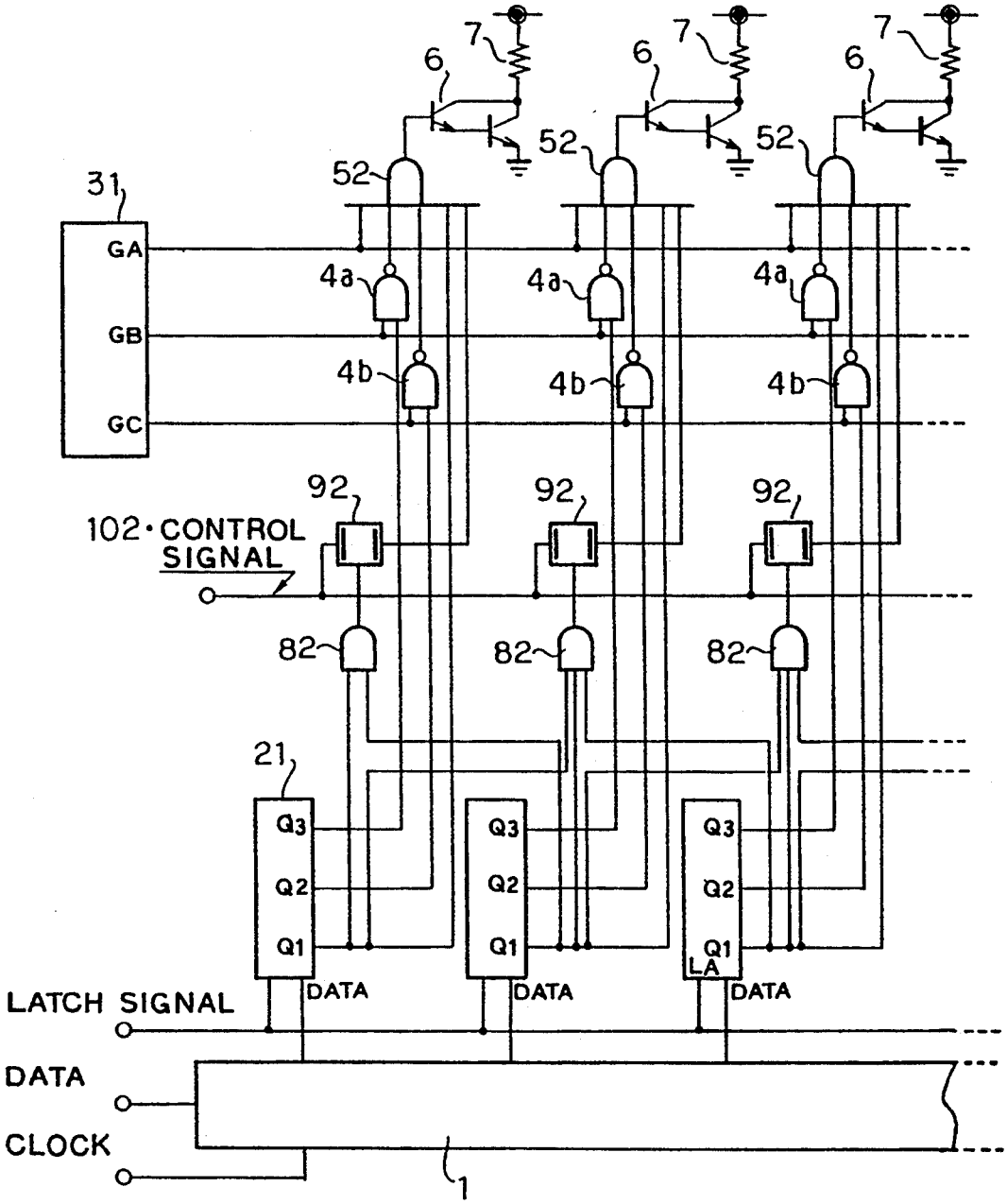
FIG. 6 is a circuit diagram showing a recording head driving device according to one embodiment of the present invention.

FIG. 6 is a circuit diagram showing a recording head driving device according to one embodiment of the present invention. In FIG. 6, reference numeral 82 indicates an AND gate electrically connected to the Q1 terminal of each of latch circuits 21, each having two input terminals adjacent to each other. Reference numeral 92 indicates analog switches each of which is turned on in response to a signal output from each of the AND gates 82.

Figure 1:
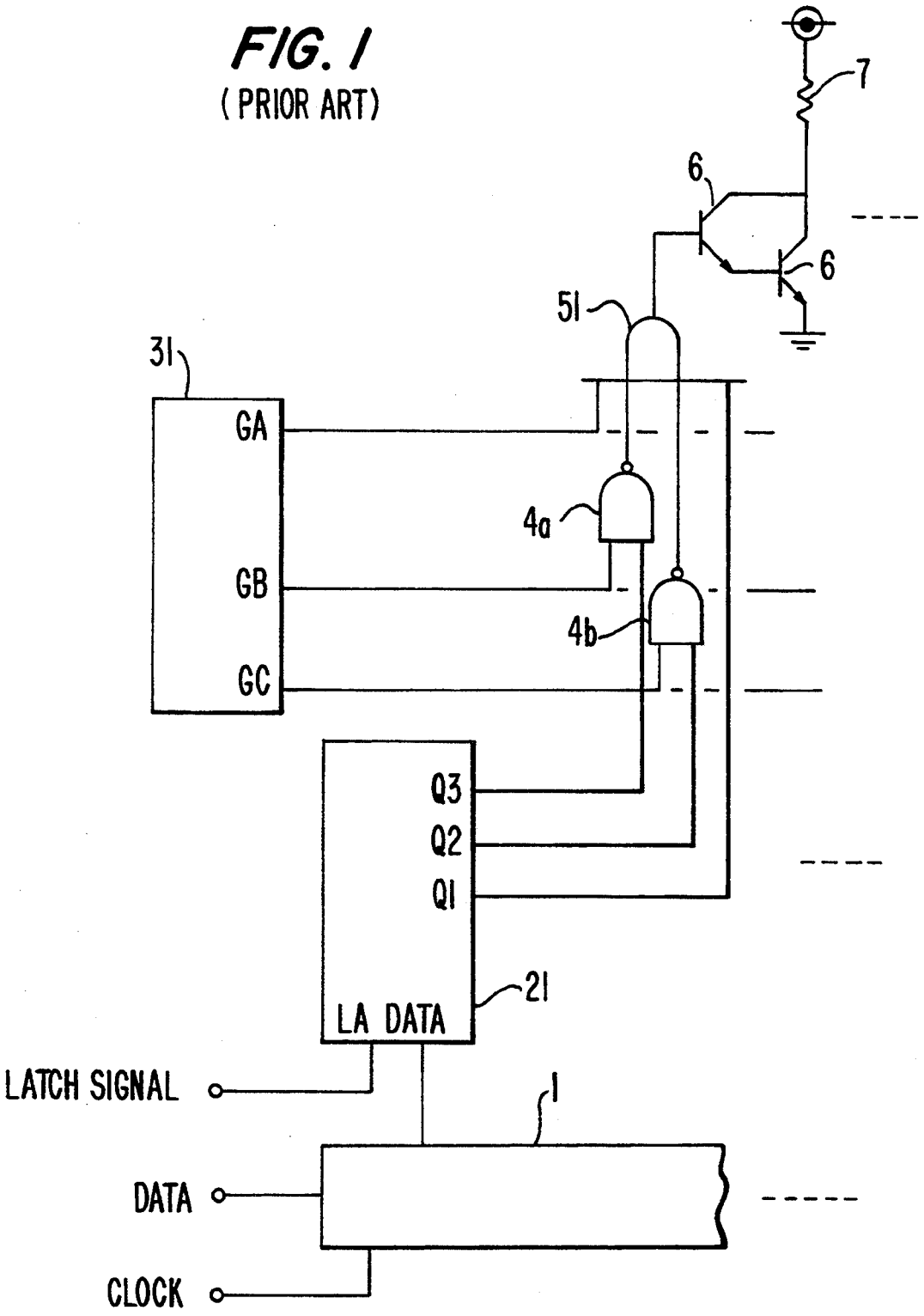
FIG. 1 (PRIOR ART)
FIG. 1 is a block diagram showing a conventional thermal head driving circuit.

Designated at numeral 102 is a control signal, which is in turn supplied to each of the analog switches 92 as a predetermined pulse signal. Reference numeral 52 indicates gate circuits serving as AND gates and reference numeral 7 indicates thermal or heating resistors serving as thermal heads. The same elements as those shown in FIG. 1 are identified by like reference numerals and the description of common elements will therefore be omitted.

The operation of the recording head driving device will now be described. Each of the latch circuits 21 successively takes in data from a shift register 1 in response to an externally-input latch signal, in a manner similar to the conventional latch circuit. Thus, information recorded or retained on the previous line, i.e., at each Q1 terminal is output to the Q2 terminal of each of the latch circuits 21, whereas the information recorded or retained on the line prior to the previous line, i.e. the Q2 terminal is supplied to the Q3 terminal of each of the latch circuits 21. However, the recorded information at the Q1 terminals of adjacent dots i.e. the adjacent respective latch circuit 21 is input to each of the AND gates 82.

Figures 7A, 7B, 7C, 7D, 7E, 7F, 7G, 7H, 7I, 7J, 7K:
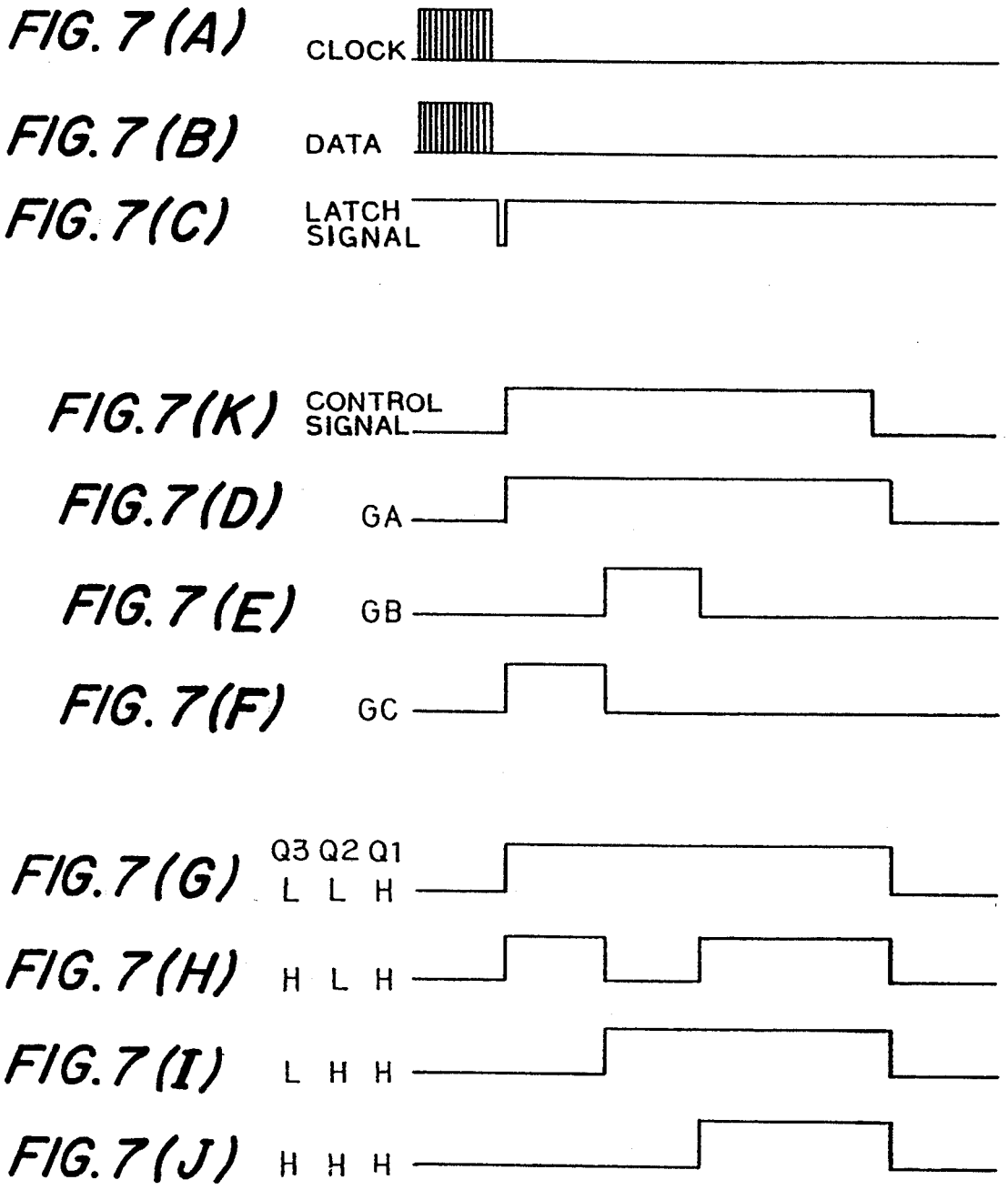
FIGS. 7A, 7B, 7C, 7D, 7E, 7F, 7G, 7H, 7I, 7J and 7K are timing charts for describing signals at respective terminal points in the circuit diagram of the recording head driving device shown in FIG. 6.
Figure 8A:
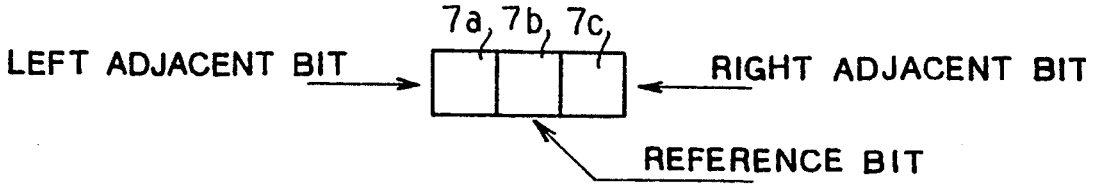
FIGS. 8A, 8B, 8C, and 8D are views for describing the influence of heat generated by a recording head relative to one bit on other bits adjacent to the one bit.
Figure 8B:
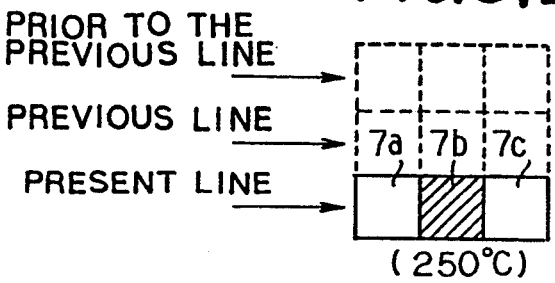
Figure 8C:
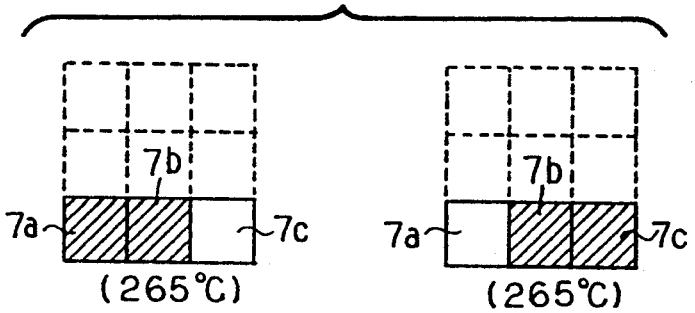
Figure 8D:
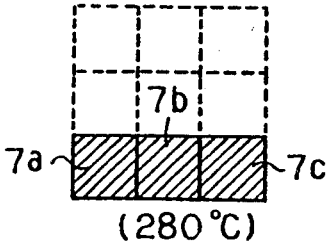

When, on the other hand, the control signal 102 is input to each of the analog switches 92 in the timing at which the latch signal shown in FIG. 7 is input, and each of the analog switches 92 is turned on in response to the output of each of the AND gates 82, the control signal is supplied to each of the gate circuits marked 52. In this case, the time required to electrically provide or supply the control signal 102 i.e. make it active is set so as to be slightly shorter than that required to make active a gate signal GA of a gate signal generator 31 as shown in FIG. 7.

When the input of any one of the AND gates 82 i.e. the signals output from the Q1 terminals of the latch circuits 21 arranged in pairs adjacent to each other are both "H" in level, the analog switch 92 electrically connected to the corresponding AND gate 82 is closed so as to supply the control signal 102 to the gate circuit 52. When, on the other hand, either one of the Q1 terminals of the adjacent latch circuits 21 or the two Q1 terminals are "L" in level, the analog switch 92 is turned off, so that the control signal 102 is not input to the corresponding gate circuit 52. Accordingly, the gate input of the gate circuit 52 is brought to a high impedance.

FIG. 8 shows temperatures on the surfaces of the adjacent heating resistors at the time that the heating resistors have produced heat. Let's now assume that the adjacent heading resistors are represented as *7a*, *7b*, *7c* as shown in FIG. 8 (A) . When the respective heating resistors *7a*, *7b*, *7c* are selectively activated under a given condition, heat is generated by the heating resistor *7b* but not produced by the remaining heating resistors *7a*, *7c* disposed adjacent to the heating resistor *7b*, for example. In this case, the temperature of the generated heat is 250° C. as shown in FIG. 8(B). When, on the other hand, the heat is generated by the adjacent heating resistors *7a*, *7c*, the temperature of the generated heat becomes 280° C. as illustrated in FIG. 8(D).

When the heat is generated by either one of the heating resistors *7a* and *7c*, the temperature of the generated heat reaches 265° C. Thus, a relative influence made by the heat generated from the adjacent heating resistors can be corrected to provide accurate printing by supplying the energy determined by the time required to make the control signal active to each of the heating resistors *7a*, *7b*, *7c*, thereby making it possible to obtain a well-balanced density for printing under the high-level control of heat history.

Embodiment 2

Figure 9:
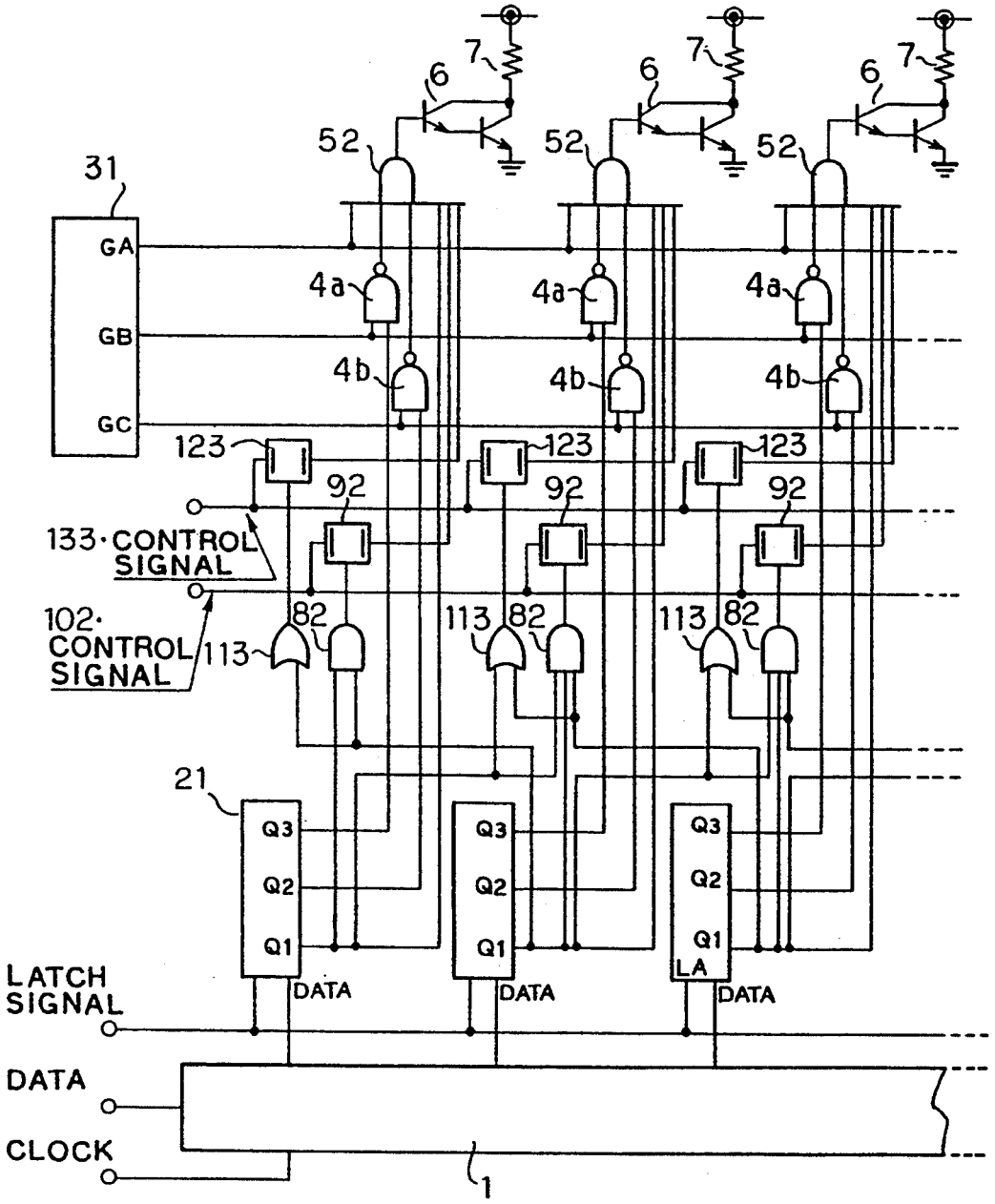
FIG. 9 is a circuit diagram showing a recording head driving device according to another embodiment of the present invention.

FIG. 9 is a circuit diagram showing a thermal head driving device according to another embodiment of the present invention. The thermal head driving device makes use of dual control signals 102 and 133 to control the time required to energize each heating resistor. In addition, the Q1 terminals of adjacent latch circuits 21 are electrically connected to corresponding AND gates 82 respectively, and the Q1 terminals of the other adjacent latch circuits 21 excluding the inherent or initial latch circuit 21 are electrically connected to respectively corresponding OR gates 113. In this condition, the control signals 102 and 133 are input to each of the gate circuits 52 via respectively corresponding analog switches 92 and 123 which are respectively opened and closed according to the output of the AND gate 82 and the output of the OR gate 113.

The control signal 102 is input to each of the gate circuits 52 during a period in which each of the analog switches 92 is in the on state. Therefore, when an information pair relative to adjacent bits; of the recorded information on the present each line, are both "H" in level, the energization of each heating resistor is completed based on a width corresponding to a time interval, which is shorter than the normal maximum width, corresponding to the maximum time interval of a gate signal GA of a gate signal generating unit 31.

The control signal 133 is input to each of the gate circuits 52 during a period in which each of the analog switches 123 is in an on state. Therefore, when either one of the pair of information based on the adjacent bits, of the recorded information on the present each line is "L" in level, each of the heating resistors 7 is energized based on the width shorter than that of the gate signal GA. It is therefore possible to realize a higher-level control of heat history compared with the previously described embodiment.

Figures 10A, 10B, 10C, 10D, 10E, 10F, 10G, 10H, 10I, 10J, 10K, 10L:
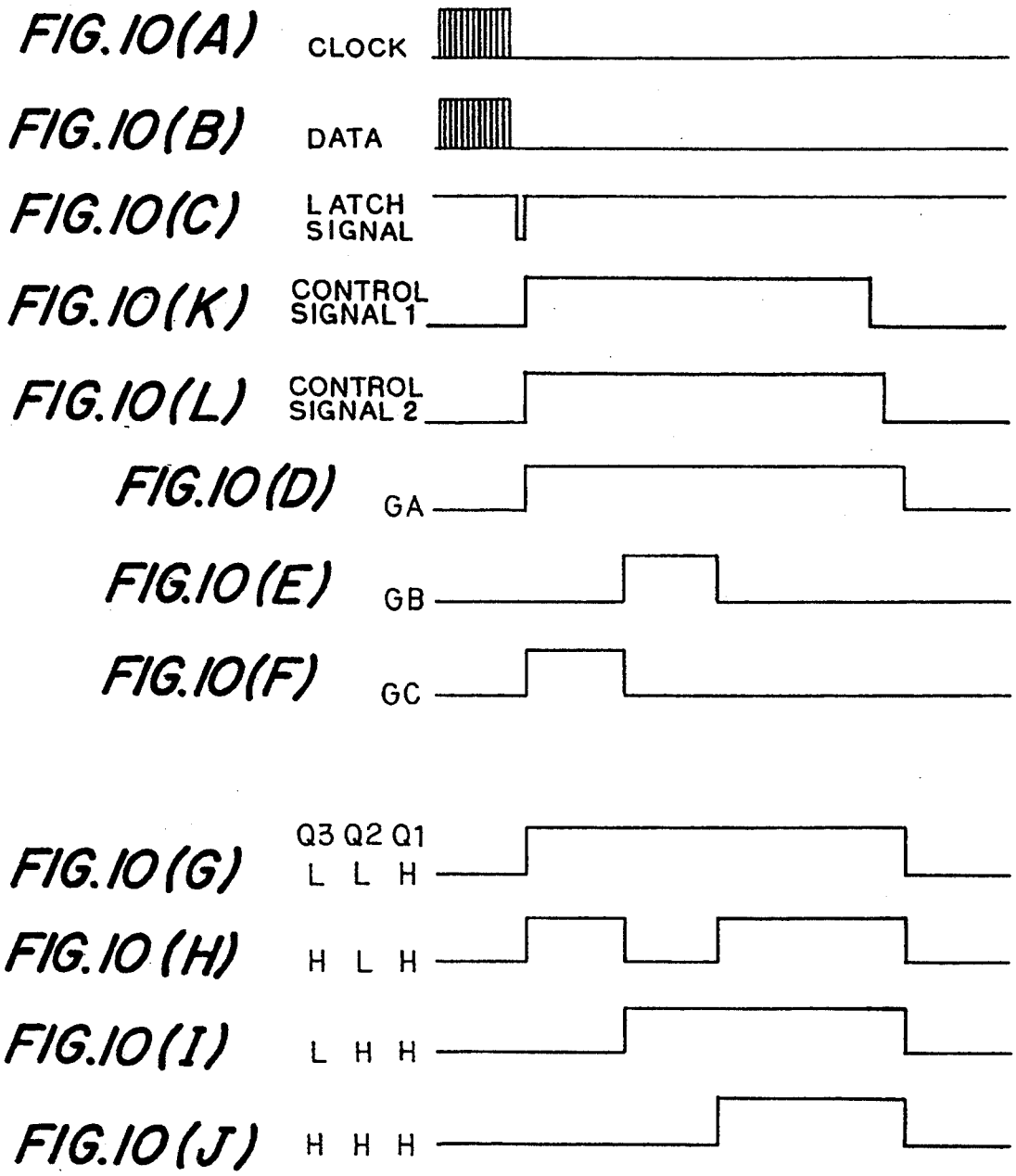
FIGS. 10A, 10B, 10C, 10D, 10E, 10F, 10G, 10H, 10I, 10J, 10K and 10L are timing charts for describing signals at respective terminal points in the circuit diagram of the recording head driving device shown in FIG. 9.

FIG. 10 is a timing chart for describing the timing relationship between the time required to make the control signals 102 and 133 active, and the time required to make the gate signals GA, GB, GC of the gate signal generating unit 31 active. The signals 102 and 133 and the gate signal GA rise simultaneously but the time required to make the control signal 102, the control signal 133 and the gate signal GA active, takes place in the above order.

That is, the time required to make the control signals 102 and 133 active, and the time required to make the gate signals GA, GB, GC active are respectively associated with 280° C., 265° C. and 250° C. each of which represents the temperature of the heat generated by each of the heating resistors associated with the adjacent bits shown in FIG. 8. When the generated heat is high in temperature, each time referred to above is reduced. In the present embodiment, the time required to make each signal active is determined so as to be associated with 250° C. or so. Accordingly, when the heat is generated by the heating resistors associated with both bits adjacent to a corresponding bit relative to the remaining heating resistor in the heating resistors 7 as shown in FIG. 8(D), the time required to energize each heating resistor is determined by the control signal 102. When the heat is generated by the heating resistor associated with one of the adjacent bits as shown in FIG. 8(C), the time required to energize each heating resistor is decided by the control signal 133.

When, on the other hand, the heat is not generated by the heating resistors associated with both of the adjacent bits, the time required to energize each heating resistor is determined by the gate signal GA of the gate signal generating unit 31. It is thus possible to perform the control for printing with a higher accuracy than that of the first embodiment.

Embodiment 3

Figure 11:
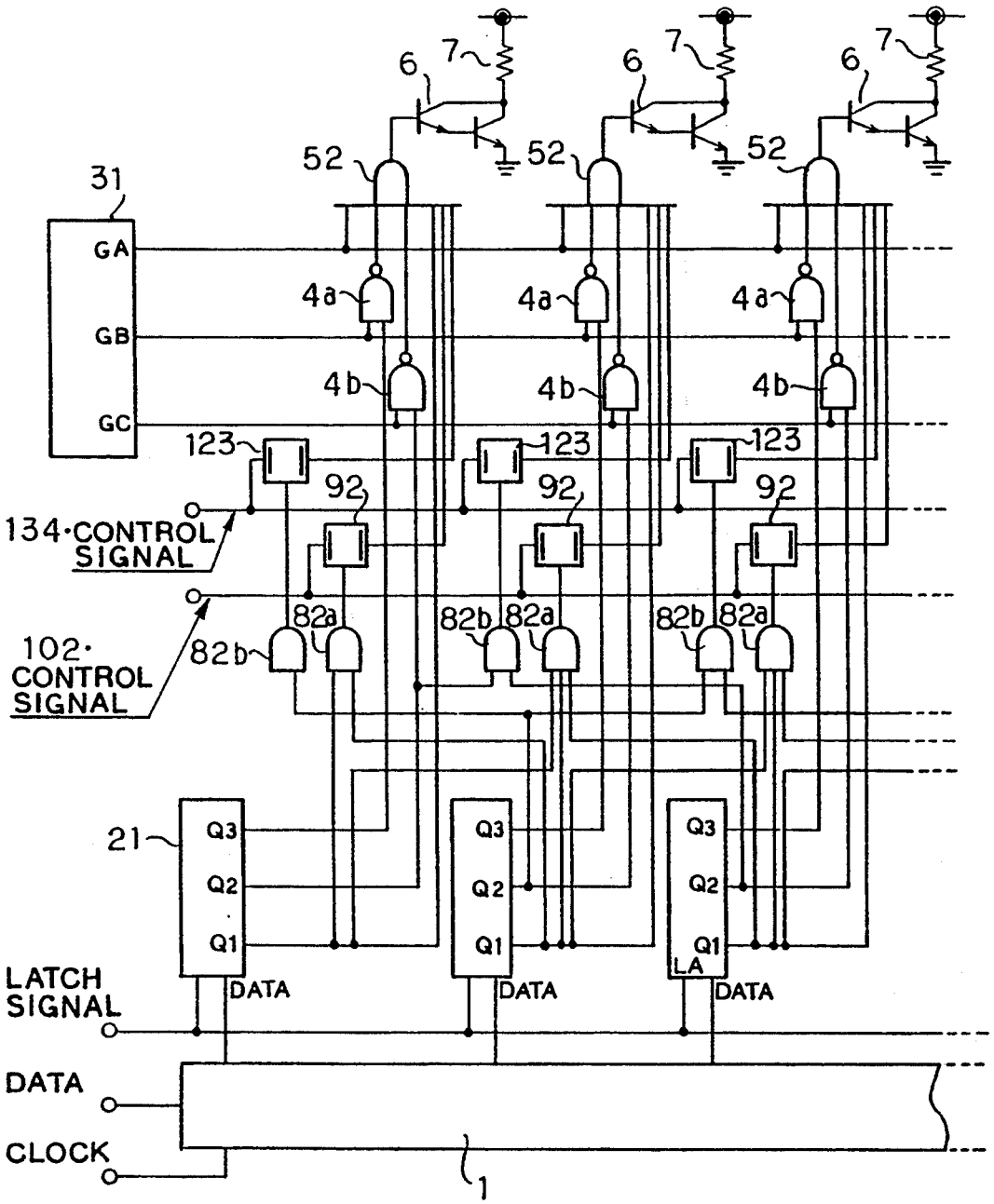
FIG. 11 is a circuit diagram illustrating a recording head driving device according to a further embodiment of the present invention.

FIG. 11 is a circuit diagram of a recording head driving circuit according to a further embodiment of the present invention. Even adjacent recorded information on each previous line i.e. from each Q2 terminal is input to each of gate circuits 52 as input information as well as adjacent recorded information on each present line. The recorded information on each present line is obtained from each of the first AND circuits 82*a*, and the past recorded information is obtained from each of second AND circuits 82*b*.

Thus, the past adjacent recorded information is also fed back to the recorded information based on a corresponding bit at the present line, thereby controlling the energization of each heating resistor 7. In this case, the timing for making each of signals 102 and 134 active is similar to that shown in FIG. 10. The control signal 134 is based on the control signal 133. As a result, the printing density can be controlled with higher accuracy in the present embodiment, compared with the second embodiment.

Embodiment 4

Figure 12:
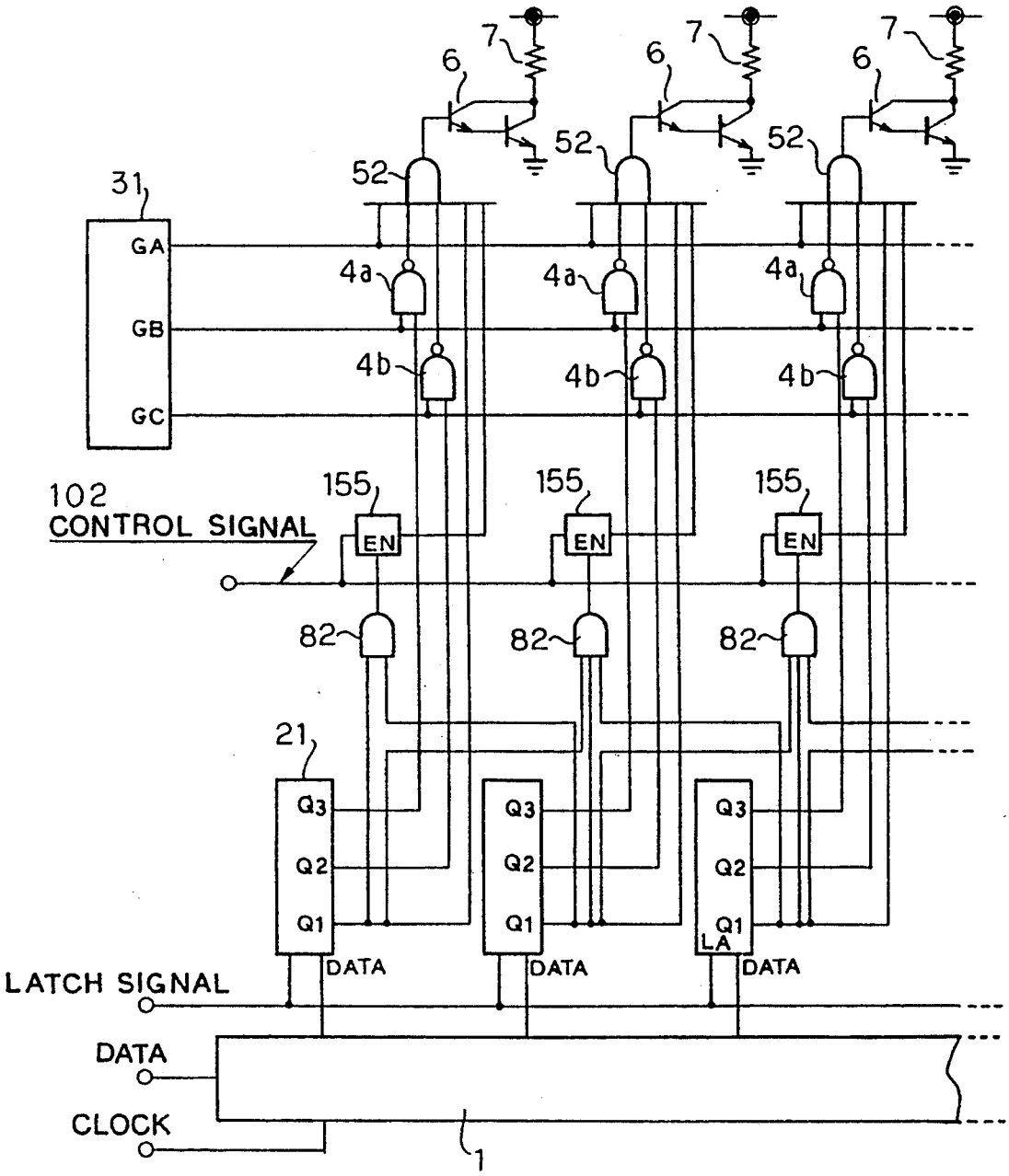
FIG. 12 is a circuit diagram depicting a recording head driving device according to a still further embodiment of the present invention, which corresponds to the recording head driving device shown in FIG. 6 whose parts are modified.

FIG. 12 is a circuit diagram showing a recording head driving circuit according a still further embodiment of the present invention, in which normal three-state buffers 155 are used as an alternative to the analog switches 92. However, any switch similar to the analog switches 92 can be used. In this case, the present embodiment can bring about the same advantageous effects as those obtained by the first embodiment shown in FIG. 6. In addition, the output of each present line i.e. each Q1 terminal, which is represented in the form of bits, is input to each of the AND gates 82. However, this process may be omitted. Furthermore, the first and final bits of the adjacent bits are suitably adjusted in number because the number of gates is insufficient. Further, logic circuits or the like may be used as an alternative to the three state buffers 155 and the analog switches 92.

Embodiment 5

Each of the embodiments 1 through 4 shown in FIGS. 6, 9, 11 and 12 respectively is of a circuit configuration of three states and has the gate inputs of the gate circuits 52, which are brought to a high impedance. However, pull-up resistors may be used to stabilize the logic.

Embodiment 6

In the above embodiments, the control signals 102, 133 and 134 are output independent of the gate signal generating unit 31. However, the respective control signals may be output from the gate signal generating unit 31, whereas the gate signals to be output from the gate signal generating unit 31 may be input externally.

Embodiment 7

In the above embodiments, the thermal head driving circuit has been described. However, the embodiments can be applied to the control of an LED head serving as a recording head used with an LED light source, for example. Otherwise, the embodiments may also be used in the drive control of recording heads used for an ink-jet, a bubble jet, etc.

Embodiment 8

Further, each of the above embodiments is directed to a case in which each of the latch circuits 21 is provided with the Q1, Q2, Q3 terminals as three stages. However, the latch circuit 21 may be provided only with a one-stage Q terminal. It may also be provided with more than three stage terminals.

Embodiment 9

In the above embodiments, the reference to the adjacent bits on each previous line is made only with respect to the previous line. However, this reference may be made to further previous lines or after. In addition, this reference may be made to the bits adjacent to the corresponding bit. Otherwise, a number of continuous dots may be used as adjacent bits with respect to the corresponding bit.

Embodiment 10

Figure 13:
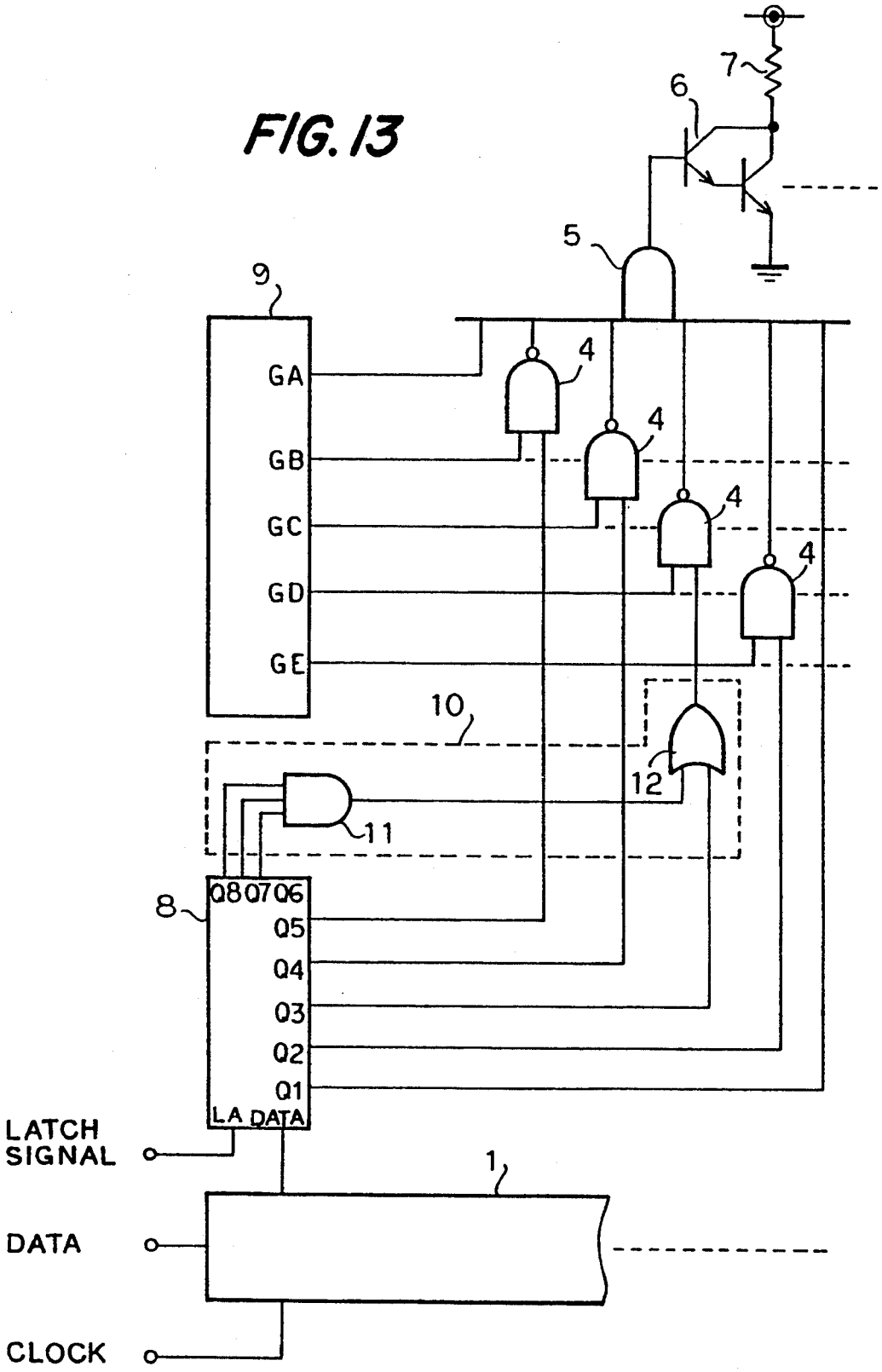
FIG. 13 is a circuit diagram showing a recording head driving device according to a still further embodiment of the present invention.

FIG. 13 is a block diagram showing a thermal head driving circuit according to a still further embodiment of the present invention. FIG. 13 includes a shift register 1, NAND gates 4 serving as a gate circuit, an AND gate 5 serving as a gate circuit, a darlington transistor 6 serving as a drive circuit and a thermal or heating resistor 7. These components are identical or similar to those shown in FIG. 1 to which the same reference numerals have been applied, and their detailed description will therefore be omitted. Designated at numeral 8 is a latch circuit different from that designated at numeral 21 in FIG. 1, in that recorded information on the present line and record information on the past 7 lines are retained therein. Reference numeral 9 indicates a gate signal generating unit different from that designated at numeral 31 in FIG. 1 in that gate signals GD and GE are generated in addition to the gate signals GA through GC.

Designated at numeral 10 is a collating circuit for feeding back the past latch outputs Q6, Q7 and Q8 of the latch circuit 8 to the Q3 output terminal of the latch circuit 8. Designated at numeral 11 in the collating circuit 10 is an AND gate supplied with the latch outputs from Q6 to Q8. Reference numeral 12 indicates an OR gate which performs a logical sum (hereinafter called "OR") operation on the output of the AND gate 11 and the Q latch output.

The operation of the present embodiment will now be described below. The latch circuit 8 takes in data indicative of recorded information from the shift register 1 in response to a latch signal in a manner similar to the conventional latch circuit 21. In this case, the latch circuit 8 is an eight-stage configuration. Therefore, the recorded information held one line before the present line appears at the Q2 terminal, the recorded information held two lines before appears at the Q3 terminal, the recorded information held three lines before appears at the Q4 terminal, etc.

Figure 2:
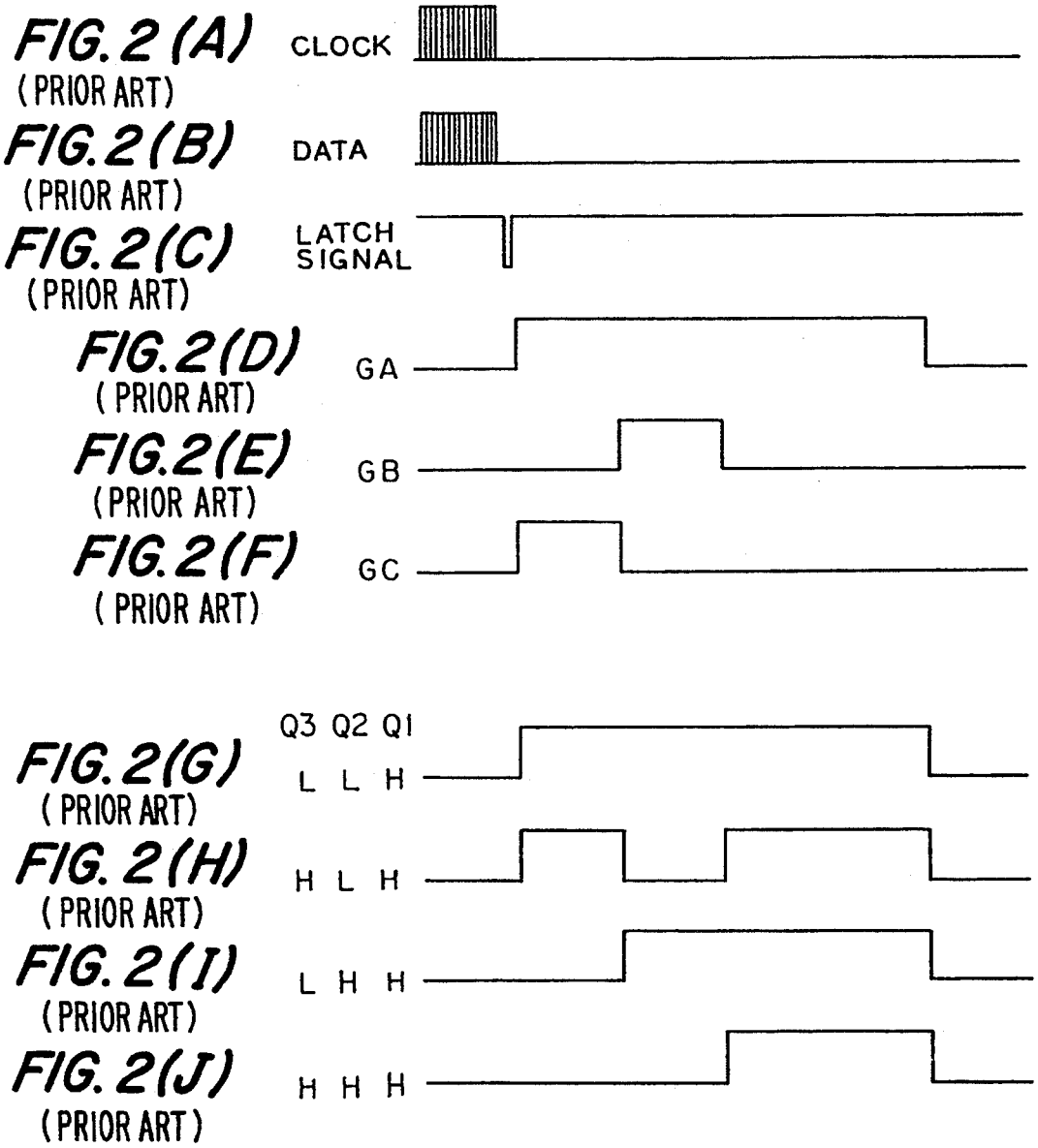
FIG. 2 (A) (PRIOR ART)
FIG. 2 (B) (PRIOR ART)
FIG. 2 (C) (PRIOR ART)
FIG. 2 (D) (PRIOR ART)
FIG. 2 (E) (PRIOR ART)
FIG. 2 (F) (PRIOR ART)
FIG. 2 (G) (PRIOR ART)
FIG. 2 (H) (PRIOR ART)
FIG. 2 (I) (PRIOR ART)
FIG. 2 (J) (PRIOR ART)
FIGS. 2A, 2B, 2C, 2D, 2E, 2F, 2G, 2H, 2I and 2J are timing charts for describing the operation of the thermal head driving circuit shown in FIG. 1.
Figure 3:
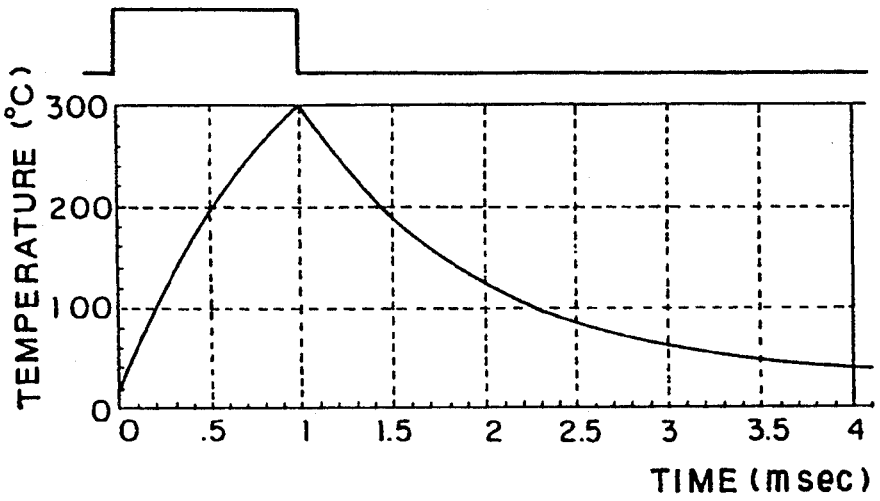
FIG. 3 (A) (PRIOR ART)
FIGS. 3A and 3B are graphs for describing the relationship between a pulse applied to each of the thermal resistors employed in the conventional thermal head driving device and the temperature of the thermal resistor.
Figure 3:
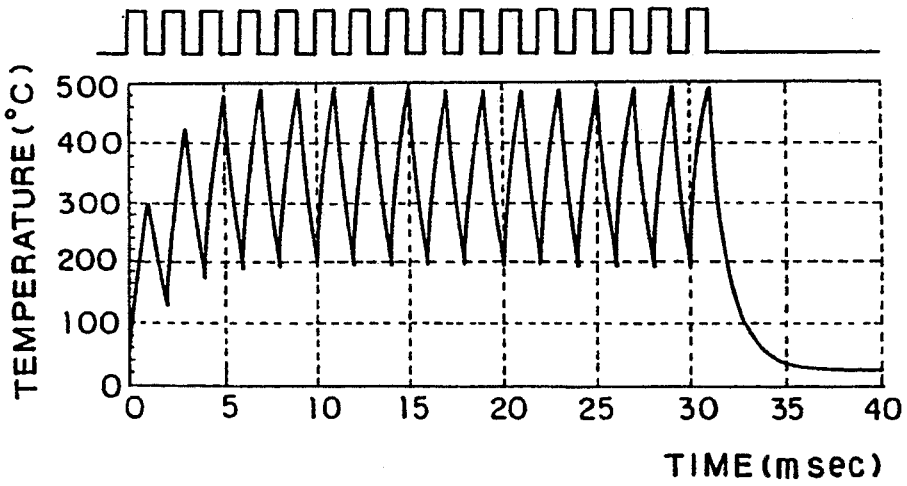
FIG. 3 (B) (PRIOR ART)
Figures 4A, 4B, 4C, 4D:
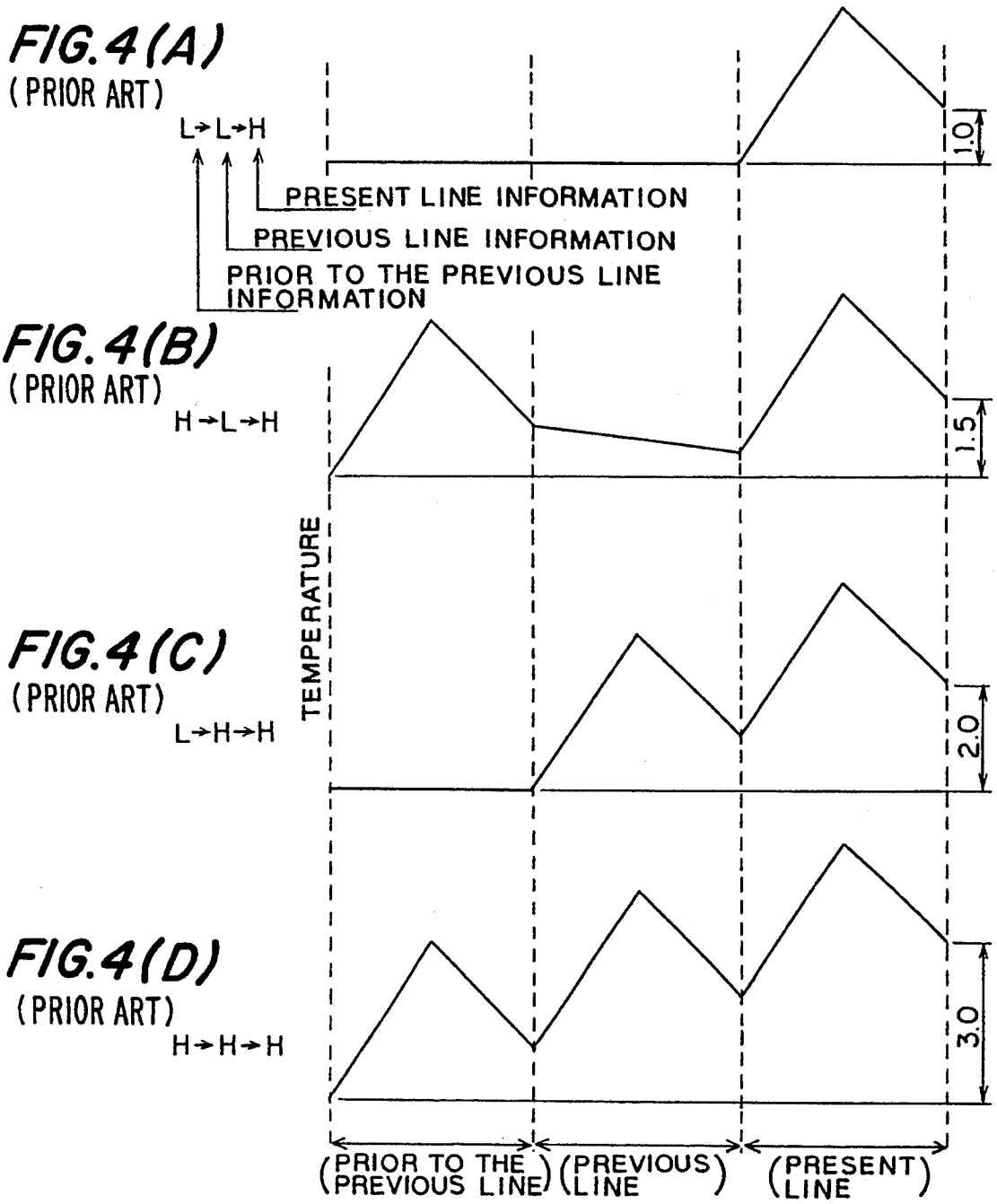
FIG. 4(A) (PRIOR ART)
FIG. 4(B) (PRIOR ART)
FIG. 4(C) (PRIOR ART)
FIG. 4(D) (PRIOR ART)
FIGS. 4A, 4B, 4C and 4D are simplified views for describing increases in temperature relative to four kinds of latch patterns output from the latch circuits in the conventional thermal head driving device.

When the patterns to be controlled are of the four kinds as in the conventional example (see FIG. 5), they are controlled by the three kinds of gate signals GA through GC as illustrated in FIGS. 2(D) through 2(J). That is, when a pattern is represented by (H, L, H) as shown in FIG. 2(H), it is controlled by the gate signals GA, GB. When, on the other hand, a pattern is represented by (L, H, H), it is controlled by the gate signals GA, GB, GC. By so doing, the energization of each line can be easily carried out.

However, when the control for energizing the present line with respect to the corresponding dot is performed in consideration of control information on the past four lines, the patterns to be controlled increase up to 16 kinds as illustrated in FIG. 14.

When the patterns as the objects to be controlled are classified into sixteen kinds, the control for energization of each line can be simply carried out so long as the five kinds of gate signals GA to GE are present. However, when many kinds of patterns are further used and have to be controlled, the number of output signal lines of the gate signal generating unit 9 increases, with the result that a suitable control method cannot be provided in practice. Thus, in the present embodiment, only the past recorded information on specific patterns, which is associated with the latch outputs subsequent to the latch output Q6, is fed back to the corresponding Q output terminal to thereby perform the current control flow.

When a bar-code pattern is used for example, it comprises five thick bars and two thin bars and is regular. Thus, the latch outputs Q1 to Q5 are identical in the recorded information to one another, whereas the latch outputs Q6 to Q8 have completely different information from one another. Accordingly, when the control for energizing each heating resistor is performed only by the latch outputs Q1 to Q5 in this case, the current for generating the same amount of heat is supplied to the heating resistor 7.

Figure 15:
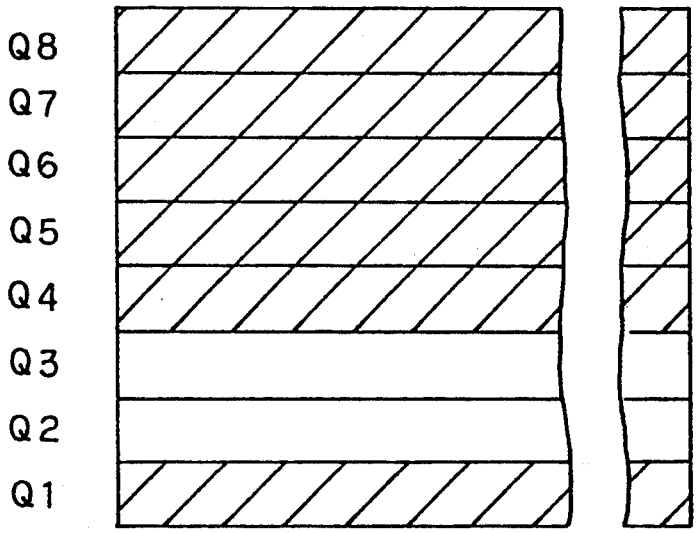
FIGS. 15A and 15B are views showing one example of a bar-code pattern for describing the operation of the recording head driving device shown in FIG. 13.

Thus, in the present embodiment, the latch outputs Q6 to Q8 are supplied to the collating circuit 10. That is, the latch outputs Q6 to Q8 are collectively input to the AND gate 11, which in turn ANDs the inputs. The result of ANDing is input to the OR gate 12 and fed back to the latch output Q3. When all the latch outputs Q6, Q7, Q8 are represented as black (H) as shown in FIG. 15(A) by way of example in this condition, the output of the NAND gate 4 supplied with a signal from the OR gate 12 is turned off at all times during a period in which the gate signal GD is being output to the NAND gate 4 (i.e., it is "H" in level). By so doing, the time interval i.e. the period required to supply the energy corresponding to the amount of the generated heat can be reduced when the long and black "H" has been printed in the past and the stored amount of the generated heat has increased.

When, on the other hand, at least one of the latch outputs Q6, Q7, Q8 is represented as white ("L"), the output of the AND gate 11 in the collating circuit 10 is rendered low in level, and the OR gate 12 passes through the latch output Q3 as is. Accordingly, the control for the energization of each heating resistor 7 is carried out in accordance with the patterns of the latch outputs Q1 to Q5.

Figure 15B:
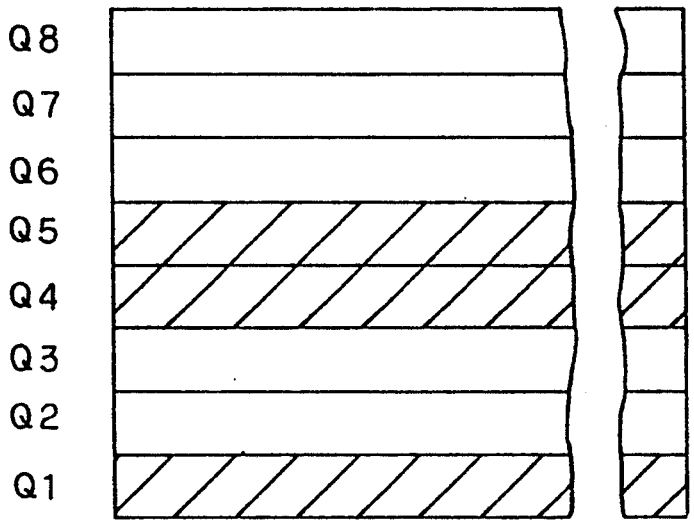

It should thus be apparent that the pattern shown in FIG. 15(A) provided with the continuous black bars in the past makes an increases in the storage of the generated heat as compared with the pattern shown in FIG. 15(B) provided with the continuous white bars in the past. However, the present embodiment can cope with this without increasing the number of the signals output from the gate signal generating unit 9 even in that case.

Embodiment 11

The above embodiment 10 is directed to a case in which the latch outputs Q6 to Q8 are collectively input to the AND gate 11 of the collating circuit 10 where they are collated with the latch output Q3, followed by the control for the energization of the heating resistor. However, the latch circuit 8 may be of a seven-stage configuration, and the latch outputs Q5 through Q7 from the latch circuit 8 may be collectively input to the AND gate 11 of the collating circuit 10. It is also unnecessary to regard the number of the latch outputs, input to the AND gate 11 as three inputs. The number of latch outputs can be arbitrarily changed to more than or equal to 1. Further, the output of the OR gate 12 of the collating circuit 10 may also be fed back to specific latch outputs as Q terminals more than or equal to 1 as an alternative to the latch output Q3.

Embodiment 12

The above-described embodiment describes a case in which the collating circuit 10 comprises the AND gate 11 and the OR gate 12. However, the collating circuit 10 may be comprised of other logic circuits. In this case, the present embodiment can bring about the same advantageous effect as that obtained by the above embodiment.

According to a first aspect of a recording head driving device of the present invention, as has been described above, there is a number of latch circuits each of which retains information on the present line, recorded with respect to dots to be energized and respective information on the previous line, which is recorded with respect to dots to be energized, and a gate signal generating unit for outputting gate signals used to generate pulse signals each indicative of a state energizable for each recording head in accordance with each of the output patterns of the latch circuits, to gate circuits for outputting the pulse signals each indicative of the energizable state of each recording head. Each AND gate is constructed so as to input a control signal for controlling the time required to energize each recording head to each of the gate circuits in response to the recorded information output from the initial latch circuit and other adjacent latch circuits of the latch circuits provided for every dot. Therefore, the recording head driving device can bring about advantageous effects, in that the most suitable printing energy capable of providing a well-balanced printing density can be supplied to each of the recording heads in accordance with the state of recording of heat generated between the adjacent recording heads.

According to a second aspect of the recording head driving device of the present invention as well, each of the OR gates is constructed so as to input a control signal for controlling the time difference from the above energization time, which is required to energize each recording head, to each of the gate circuits in response to the recorded information output from other adjacent latch circuits; excluding the initial latch circuit of the latch circuits provided for every dot. It is therefore possible to provide the recording head driving circuit capable of controlling the printing density with higher accuracy.

Further, according to a third aspect of the recording head driving device of the present invention, there is provided a number of first AND gates each of which serves to input a control signal used to control the time required to energize each recording head to each of the gate circuits in response to the recorded information output from the initial latch circuit and other adjacent latch circuits of latch circuits provided for every dot, and a number of second AND gates each of which serves to input a control signal used to control the time difference from the above energization time, which is required to energize each recording head, to each of the gate circuits in response to the past recorded information output from other adjacent latch circuits excluding the initial latch circuit of the latch circuits provided for every dot. It is therefore possible to realize the control of printing density sufficiently and highly accurately based on history data which have been recorded.

Furthermore, according to a fourth aspect of the recording head driving device of the present invention, there is number of collating circuits each activated to allow a latch circuit to retain recorded information on at least the past three lines as previous recorded information, and to feed back the past latch outputs of the latch circuit to any one of the outputs of the latch circuit. It is therefore possible to provide the recording head driving device which is capable of controlling the amount of heat generated by each heating resistor which has made reference to the past recorded information, and suitably controlling the history without increasing the number of gate signals-generated by a gate signal generating unit even if the number of patterns to be controlled increases.

Having now fully described the invention, it will be apparent to those skilled in the art that many changes and modifications can be made without departing from the spirit or scope of the invention as set forth herein.

What is claimed is:

1. A thermal recording head driving device for driving a plurality of thermal recording heads associated with respective dots to be energized comprising:

a number of latch circuits for retaining information on the energization of the thermal recording heads in the present line which is indicative of the temperature of the thermal heads in said present line, which is recorded with respect to dots serving as objects to be energized, and for retaining respective information on the energization of the thermal recording heads in the previous lines which is indicative of the temperature of the thermal heads in said previous lines, which is recorded with respect to dots serving as objects to be energized;

a number of gate circuits for outputting pulse signals each indicative of an energizable state of each thermal recording head therefrom;

a gate signal generating unit for outputting gate signals to generate the pulse signals each indicative of the energizable state of each thermal recording head in accordance with each of output patterns of the said latch circuits, to said gate circuits; and a number of AND gates for inputting control signals to control the time required to energize the said thermal recording heads to each of the said gate circuits in response to the recorded information output from the initial latch circuit and other adjacent latch circuits of the said latch circuits provided for every dot.

2. A thermal recording head driving device for driving a plurality of thermal recording heads associated with respective dots to be energized comprising:

a number of latch circuits for retaining information on the energization of the thermal recording heads in the present line which is indicative of the temperature of the thermal heads in said present line, which is recorded with respect to dots to be energized and for retaining respective information on the energization of the thermal recording heads in the previous lines which is indicative of the temperature of the thermal heads in said previous lines, which is recorded with respect to dots to be energized;

a number of gate circuits for outputting pulse signals each indicative of an energizable state of each thermal recording head therefrom;

a gate signal generating unit for outputting gate signals to generate the pulse signals, each indicative of the energizable state of each thermal recording head in accordance with each of output patterns of the said latch circuits, to the said gate circuits;

a number of AND gates each activated so as to input a control signal to control the time required to energize the said each thermal recording head to each of said gate circuits in response to the recorded information output from the initial latch circuit and other adjacent latch circuits of said latch circuits provided for every dot; and a number of OR gates each activated so as to input a control signal used to control the time different from the said energization time, which is required to energize the said each recording head, to each of the said gate circuits in response to the recorded information output from other adjacent latch circuits excluding the initial latch circuit of the said latch circuits provided for every dot.

3. A thermal recording head driving device for driving a plurality of thermal recording heads associated with respective dots to be energized comprising:

a number of latch circuits for retaining therein information on the energization of the thermal recording heads in the present line which is indicative of the temperature of the thermal recording heads in said present line, which is recorded with respect to dots to be energized and for retaining respective information on the energization of the thermal recording heads in the previous lines which is indicative of the temperature of the thermal heads in said previous lines, which is recorded with respect to dots to be energized;

a number of gate circuits for outputting pulse signals each indicative of an energizable state from each thermal recording head;

a gate signal generating unit for outputting gate signals to generate the pulse signals each indicative of the energizable state of each thermal recording head in accordance with each of output patterns of the said latch circuits, to the said gate circuits;

a number of first AND gates each activated so as to input a control signal used to control the time required to energize the said each thermal recording head to each of the said gate circuits in response to the recorded information output from the initial latch circuit and other adjacent latch circuits of said latch circuits provided for every dot; and a number of second AND gates each activated so as to input a control signal used to control the time difference from the said energization time, which is required to energize the said each thermal recording head, to each of the said gate circuits in response to the recorded information output from other adjacent latch circuits excluding the initial latch circuit of the said latch circuits provided for every dot.

4. A thermal recording head driving device for driving a plurality of thermal recording heads associated with respective dots to be energized comprising:

a number of latch circuits for retaining information on the energization of the thermal recording heads in the present line which is indicative of the temperature of the thermal heads in the present line and for retaining information on the energization of the thermal recording heads in the previous lines which is indicative of the temperature of the thermal heads in said previous lines, both of which are recorded with respect to dots serving to be activated for recording heads;

a number of gate circuits for outputting pulse signals indicative of energizable states of heating resistors associated with the dots serving as the objects to be activated for the said recording heads on the basis of output patterns of the said latch circuits, respectively;

a gate signal generating unit for generating gate signals used to produce the pulse signals indicative of the energizable states of the said heating resistors based on the output patterns of the said latch circuits respectively and for supplying the said generated gate signals to the said gate circuits respectively;

a number of drive circuits for driving the said heating resistors in response to the pulse signals output from the said gate circuits respectively; and a number of collating circuits each activated to allow the said latch circuit to retain the recorded information on at least the past three lines as the recorded information on the said previous lines and to feed back the past latch outputs of the said latch circuit to any one of the outputs of the said latch circuit.

* * * * *